United States Patent [19]

Dorst

[11] Patent Number: 5,032,044

[45] Date of Patent: Jul. 16, 1991

[54] LIGHT WEIGHT STOWABLE FRONT WHEEL SEATS FOR HAULING LARGE SEMISTACKED HIGHWAY TRUCKS IN RAILROAD CARS OF EXTRAORDINARY HEIGHT

[75] Inventor: William E. Dorst, Pontiac, Mich.

[73] Assignee: Southern Pacific Transportation Company, San Francisco, Calif.

[21] Appl. No.: 513,777

[22] Filed: Apr. 24, 1990

[51] Int. Cl.[5] ..... B60P 3/07

[52] U.S. Cl. ..... 410/8; 410/13; 410/18; 410/24; 211/94.5; 211/104

[58] Field of Search ..... 410/3, 4, 7, 8, 9, 10, 410/13, 18, 19, 29, 56, 58, 66; 105/370, 371, 372, 375; 211/1.3, 94.5, 104

[56] References Cited

U.S. PATENT DOCUMENTS

| | | | |
|---|---|---|---|
| 2,016,430 | 10/1935 | Hice | 410/13 X |
| 3,611,949 | 10/1971 | Peisner | 410/10 |
| 4,120,076 | 10/1978 | Lebre | 410/8 X |
| 4,834,608 | 5/1989 | Middaugh et al. | 410/8 X |
| 4,854,790 | 8/1989 | Andre | 410/19 X |

*Primary Examiner*—Robert J. Spar
*Assistant Examiner*—Craig Slavin
*Attorney, Agent, or Firm*—Antonio M. Fernandez

[57] ABSTRACT

A railroad car having a flat bed at the lowest possible level and a roof and side panels supported by stanchions at an extraordinary height is provided with cantilevered wheel seats for support of the front wheels of semistacked trucks with each truck backed into position by a forklift with the front end of the truck raised and its rear frame tucked in under the front end of a preceding truck. Side rails secured to the stanchions about one foot from the bed and about six inches in front of the stanchions help guide the trucks into proper position. Each wheel seat is comprised of two cantilevered box beams inserted into box receptacles supported by horizontal side box beams secured to the stanchions. A cross beam secured to the free end of the cantilevered box beams enhance the ability of the cantilevered box beams to support the weight of the truck and provide a place to secure an eye that receives a hook of a tie-down chain in a position directly below the front wheel axle of the truck.

7 Claims, 5 Drawing Sheets

LIGHT WEIGHT STOWABLE FRONT WHEEL SEATS FOR HAULING LARGE SEMISTACKED HIGHWAY TRUCKS IN RAILROAD CARS OF EXTRAORDINARY HEIGHT

TECHNICAL FIELD

This invention relates to a railroad car of extraordinary height for hauling trucks without bodies on the frames behind the cabs, characterized by the frame of each truck tucked under the cab of the preceding truck loaded with it front end raised, and more particularly to improved front wheel seats for loaded trucks, optimum height and width of the railroad car and manageable means for picking up the front end of each truck in succession as they are loaded into the railroad car with the frame of each truck well under the cab of a preceding truck.

BACKGROUND ART

A railroad car that solves many of the problems of the prior art in hauling large trucks is disclosed in U.S. Pat. No. 4,834,608. The car is completely enclosed making it difficult for a casual vandal to even ascertain whether or not it is hauling trucks. A jack traveling on tracks along the bed of the enclosed railroad car is used to pick up by its front axle the front of each truck loaded in succession to back it into position with its front end raised and its frame tucked under the front end of the preceding truck.

Raised platforms on the sides of the railroad car bed provide a channel between them to accommodate the traveling jack, but that significantly decreases the headroom of the railroad car which may be needed for clearance over the cabs of the trucks being loaded. Considering that this railroad car of extraordinary height is built with the roof already as high as possible for the standard height of overpasses, tunnels, and the like, the use of raised platforms is undesirable.

Longitudinally movable seats for the front wheels of the trucks hauled eliminate the need for temporary, usually makeshift, devices of the prior art to hold in a raised position the front end of each truck loaded. The wheel platforms disclosed in the aforesaid patent hang vertically while stowed until a truck being loaded is in proper position. Then they are moved longitudinally along beams secured to the sides of the railroad car into position along side of the truck's front wheels and pivoted up into a horizontal position under the front wheels. There they are secured in a horizontal position by diagonal arms (struts). The problem with that arrangement for front wheel seats is that they are so heavy that they require two persons to move and position each one safely.

STATEMENT OF THE INVENTION

An object of the present invention is to more efficiently utilize the space of a railroad car having an extraordinary height for hauling large semistacked highway trucks, each with or without a cab on the frame and no body behind the cab.

A further object is to provide front wheel seats that may be readily placed in proper position by one person as each truck is loaded with its front end raised and its frame behind the front end tucked under the front end of a preceding truck.

The bed of the railroad car is provided as a planar surface throughout at the lowest possible level in order to maximize height inside the railroad car which is completely enclosed by walls on the sides, a roof, and doors on the ends, preferably doors that roll up. A conventional forklift is used to raise the front end of each truck while it is backed into the railroad car as they are loaded in sequence and semistacked with the rear frame of each truck tucked under the front wheels of a preceding truck. Guide rails near the bed of the railroad car and near the side walls assist in guiding the rear wheels of the trucks as they are backed into position.

Seats for the raised front wheels are provided at a predetermined position for each successive truck loaded. Each of the seats is comprised of two parallel cantilevered box beams spaced apart a distance less than the diameter of inflated tires on the front wheels and oriented with its sides at 45° with respect to a horizontal plane. For an average tire radius of R, the center-to-center spacing between box beams of a wheel seat is selected to be about $2 \times R \sin 45°$ so that for a tire of that radius the sides of the box beams facing the wheel tires will be tangent at the 45° radius positions on both sides of a vertical plane passing through the center of the wheel.

The box beams of a wheel seat are inserted into square box receptacles in a horizontal side beam affixed to the railroad car, one beam on each side throughout the length of the car. In that manner, each cantilevered wheel seat consists of two box beams inserted into two box receptacles in a side beam. A beam ties together the otherwise free ends of the two cantilevered wheel-seat box beams.

The box receptacles in the side beams are open to the outside of the railroad car so that the box beams of the wheel seats may be inserted all the way into the box receptacles with the cross beam between the otherwise free ends of the box beams abutting the box receptacles in the beams on the side wall of the railroad car. This allows the front wheel seats to be placed in a position out of the way until the trucks are loaded in succession with front wheels raised and positioned at predetermined locations. The box beams of each wheel seat protrude outside of the railroad car until the truck to be supported by the wheel seats is loaded. Thus, as each truck is loaded and placed in proper position, the wheel seats on opposite sides of the railroad car are pulled back into the car, thus retracting the box beams from the box receptacles until the cross beams pass under the front wheels of the truck. A pin is then place through aligned holes in at least one side beam, box receptacle and horizontal box beam on each side of a wheel seat to secure the cantilevered wheel seat in place.

While not in use, the front wheel seats may be stowed in vertically oriented box receptacles secured to the guide rails. A single person may readily remove a wheel seat from its stowed position and place it into box receptacles in a horizontal box beam with its cantilevered box beams protruding outside the railroad car until a truck is loaded and then pulled back in and secured in its proper position. The front wheels of a loaded truck are tied down to their respective cantilevered wheel seats by a chain between an eye on the cross beam of the wheel seat and the front wheel axle.

The novel features that are considered characteristic of this invention are set forth with particularity in the appended claims. The invention will best be understood from the following description when read in connection with the accompanying drawings.

DESCRIPTION OF THE PRIOR-ART

Figure 1:
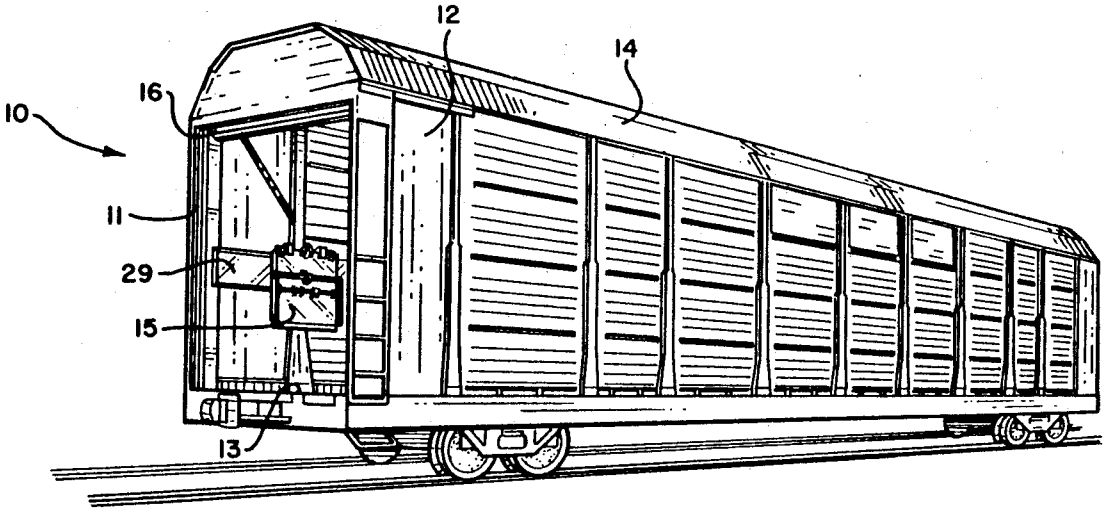
FIG. 1 (Prior Art)
FIG. 1 is a perspective view of a prior-art railroad car having extraordinary height for hauling large trucks.
Figure 2:
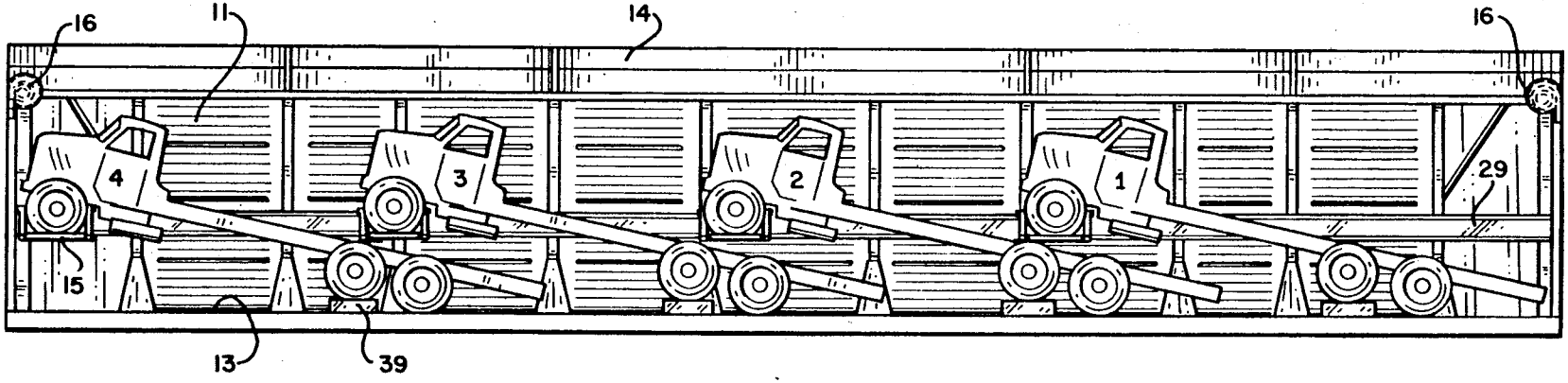
FIG. 2 (Prior Art)
FIG. 2 illustrates the method of loading large trucks in the railroad car of FIG. 1 in accordance with the prior-art patent referenced above.
Figures 3, 4:
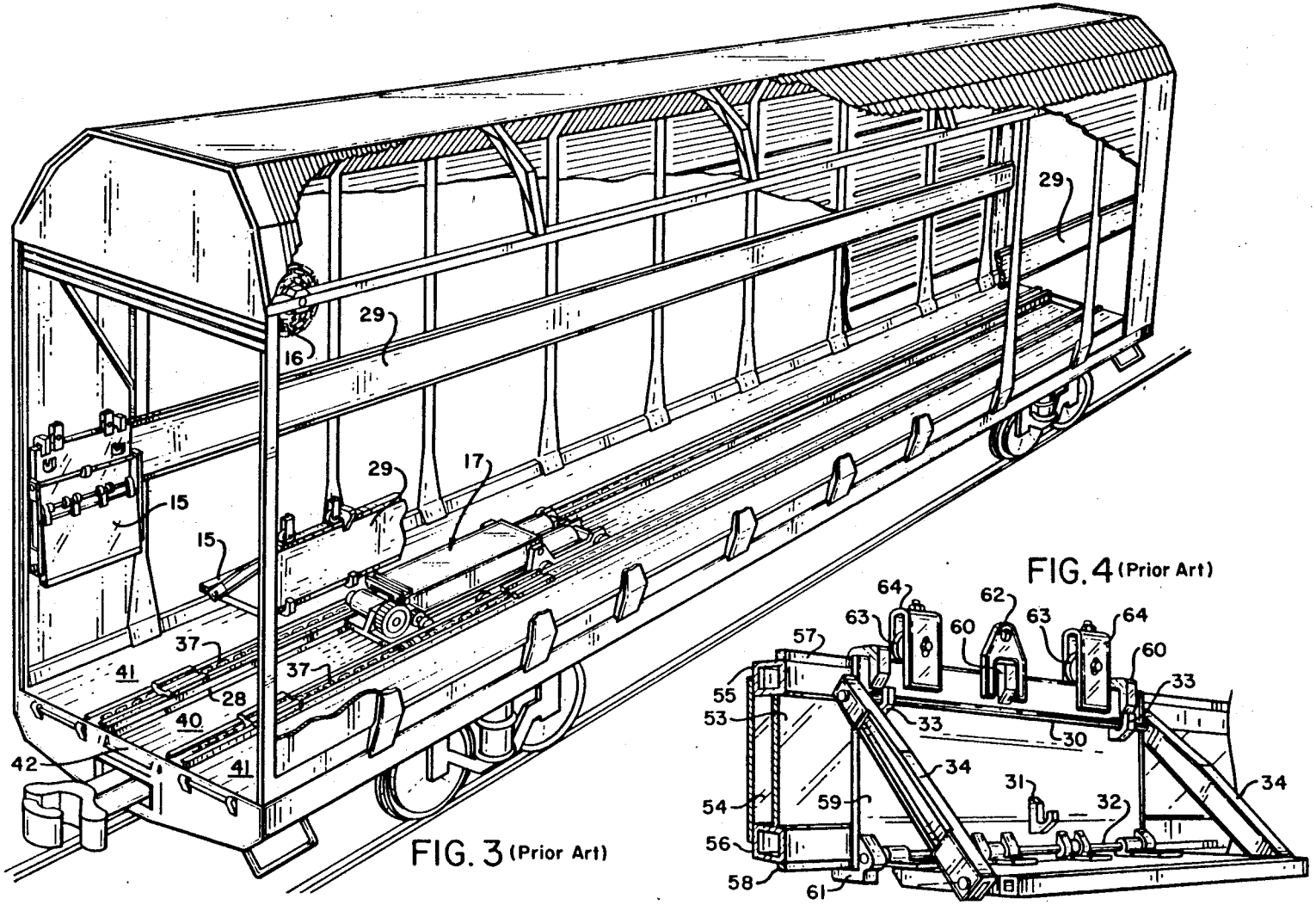
FIG. 3 (Prior Art)
FIG. 4 (Prior Art)
FIG. 3 is a larger view of the prior-art railroad car of FIG. 1 with walls partially broken away to show a channel and track for a powered lifting device that may travel the length of the car, and to show hinged platforms that may be positioned anywhere along the length of side rails to hold in an elevated position the front wheels of a truck after it is loaded onto the railroad car and positioned as shown in FIG. 2.
FIG. 4 illustrates details of a hinged platform for the elevated front wheels of a loaded truck in the prior-art railroad car of FIG. 1.

Referring to FIG. 1, a railroad car 10 having side walls 11 and 12 of extraordinary height (about 12 feet) from the deck 13 to an arcuate roof 14 is adapted for carrying large highway trucks that have frames without bodies behind the cabs, as shown in FIG. 2. With the front end of each truck lifted from its front axle onto wheel-seat platforms 15 that are hinged so that they may be stowed flat against the side of the car when not in use, as shown in FIGS. 1 and 3. The railroad car is equipped with a roll-up door 16 at each end so that the trucks may be loaded and unloaded from either end by backing the trucks in from a loading dock or ramp.

The loading procedure for the trucks illustrated in FIG. 2 is assumed to have been from the left end, and that the trucks 1, 2, 3 and 4 have been loaded in that sequence. Truck 1 is first backed into the freight car in approximately the position of truck 4, and then the front end is raised by a jack 17 shown in FIG. 3 which travels on a track that is effectively recessed by providing raised platforms on each side for the rear wheels of a truck backed into position from left to right in loading trucks as shown in FIG. 2.

Prior to raising the vehicle, the front axle is chained to the frame. Then, as the vehicle is raised, the front axle follows the frame up. The truck is transported to its destination with the axle chain attached.

With the front end of truck 1 raised by the device 17 from the front axle, the device 17 is directed to move slowly from the left end of the car 10 toward the right end until the end of the truck frame is within inches of where the roll-up door 16 will close. Then wheel-seat platforms 16 are positioned along side rails 29 on each side. Initially the platforms hang alongside the railroad car as shown in FIG. 1. Referring to just one side, when the platform is in position opposite the front wheel of the truck, a cross-bar 30 is lifted from a hook 31 and as the platform 15 is pivoted up on a pivot rod 32, the cross-bar 30 is lifted onto two hooks 33, as shown in FIG. 4. Diagonal arms 34 then hold the wheel-seat platform in a horizontal position.

Once wheel-seat platforms have been positioned opposite the two front truck wheels and secured in their horizontal position, the lifting device 17 is lowered so that the front end of the truck is allowed to seat with its two front wheels on the platforms. The truck is then tied down in position by chains secured to conventional tie-down blocks.

Trucks having tandem or dual tandem wheels in the back will have the front set of the tandem wheels elevated off the deck of the railroad car, as shown in FIG. 1. To relieve the stress on the truck frame due to the weight of the elevated wheels, blocks 39 of wood may be placed under the elevated wheels, as shown in FIG. 1, although it has been found to be unnecessary.

After truck 1 has been positioned and secured, and the lifting device is lowered, it is moved under its own power to the left end of the railroad car, as viewed in FIG. 1 to lift the front end of truck 2 which is backed into its position in the railroad car. It is then tied down. Trucks 3 and 4 are similarly lifted, backed in and tied down.

It should be noted that the lifting device must be moved under the next truck to be positioned from the rear to the front for lifting the front axle. Although the lifting device is made with a very low profile, as shown in FIG. 3, the clearance under the differential gear box is not the same for all trucks. Consequently, to assure that there is sufficient clearance for all trucks of different makes and sizes, the deck 40 of the railroad car is provided with platforms 41 about 4½ inches above the deck 40 on both sides of inverted V guide rails 28 for the lifting device 17. In that way, 4½ inches of additional clearance is provided for the lifting device 17 to pass under the differential gear boxes of the trucks. A plate 42 closes the end of the 4½-inch channel so that the lifting device is not inadvertently caused to move off the end of the deck 40. Channels 37 for the tie-down blocks are secured on top of the platforms 41.

Curbs 18 to guide the trucks while being backed into position may be provided on the outside of the truck wheel platforms 41 in the form of elongated plates less than a foot wide welded to the sides of the railroad car at an angle of about 115° from the platform. The platform is preferably made of metal plate, so welding the curb plates in place is feasible.

DETAILED DESCRIPTION OF THE INVENTION

In accordance with the present invention, a railroad car of extraordinary height, such as shown in prior-art FIGS. 1, 2 and 3, is utilized with a flat bed 40 of the railroad car as the platform for semistacked trucks, thus maximizing the headroom of the railroad car, i.e., maximizing the vertical space within the railroad car. For convenience, the same reference numerals of the prior-art figures are being retained in this detailed description of the present invention, and where the same elements referred to have been modified in structure, the reference numeral will be distinguished by an asterisk in the following figures.

Figure 5:
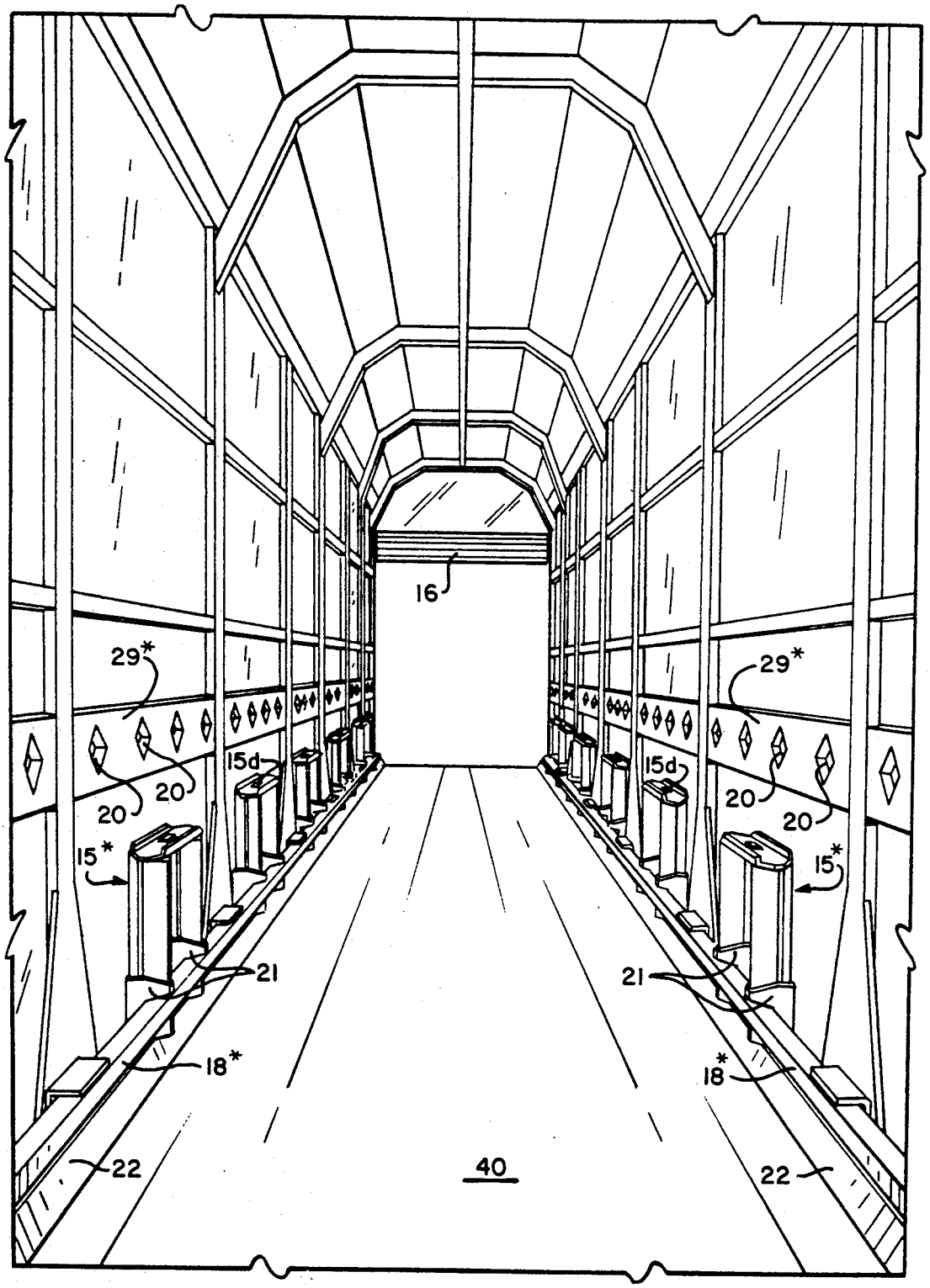
FIG. 5 is an interior perspective view of an improved railroad car for hauling a load of semistacked trucks using improved front wheel seats shown in their stowed position.
Figure 6:
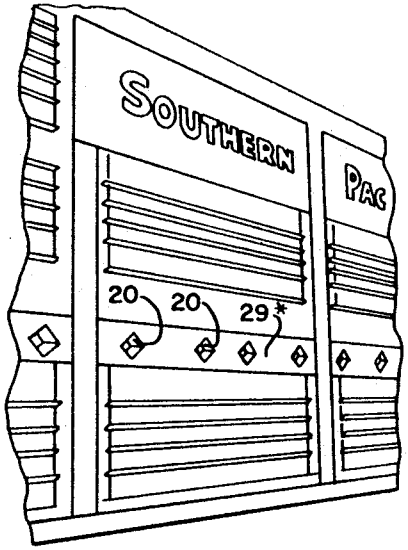
FIG. 6 is an exterior perspective view of one side of the railroad car shown in FIG. 5.

FIG. 5 shows the interior of such a railroad car equipped with a guide rail 18* about 11.125" high secured to stanchions on each side near the bed 40 with spacing between rails of about 8' 2½". The space between stanchions is about 9' 1 ⅜". Also secured to the stanchions by welding are horizontal side box beams 29* having pairs of box receptacles 20 which pass through to the outside of the railroad car, as shown in FIG. 6. The beam 29* is preferably made up of box beam welded in sections welded between stanchions at about 4.5 feet above the bed 40. The external cross-section dimensions of the box beam 29* are about 12×6 inches, and the internal dimensions of the box receptacles 20 are about 5.25×5.25 inches. The external cross-section dimensions of a cantilevered box beam for each wheel seat 15* are about 5×5 inches. The quarter inch difference between the internal dimensions of the box receptacle 20 and the external dimensions of the box beam 15* is more than ample to assure that the box beam may be inserted and extracted easily, but in order for the cantilevered box beam to rest in a horizontal position, the box receptacle is welded in a slightly inclined position, i.e., sloping up from the outside in by an angle of about 2.5°, as shown in FIG. 9*c*.

Figure 7:
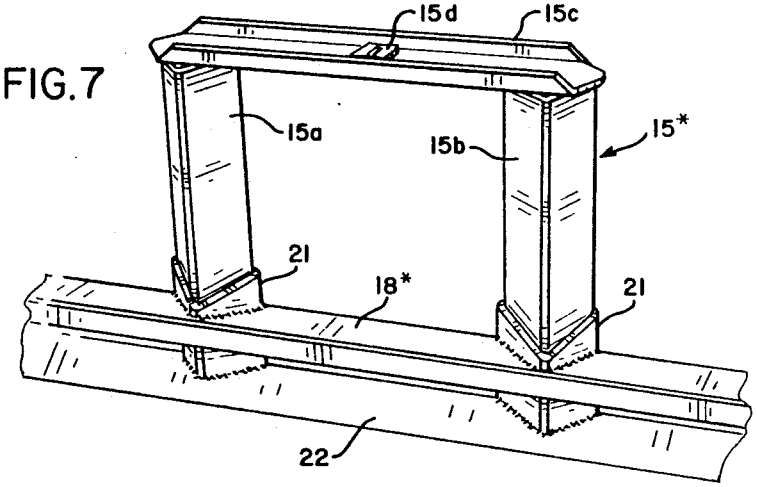
FIG. 7 is an enlarged perspective view of a wheel seat stowed in a pair of vertically oriented box receptacles between a truck guide rail and a side wall of the railroad car.

The box receptacles 20 of each pair are spaced apart a distance equal to about 28 inches center to center to receive a wheel seat 15* many of which are shown in FIG. 5 stowed in pairs of vertically oriented box receptacles 21 secured between the guide rails 18* and a metal plate 22 along the side of the railroad car by welding, as more clearly shown in FIG. 7.

Figure 8:
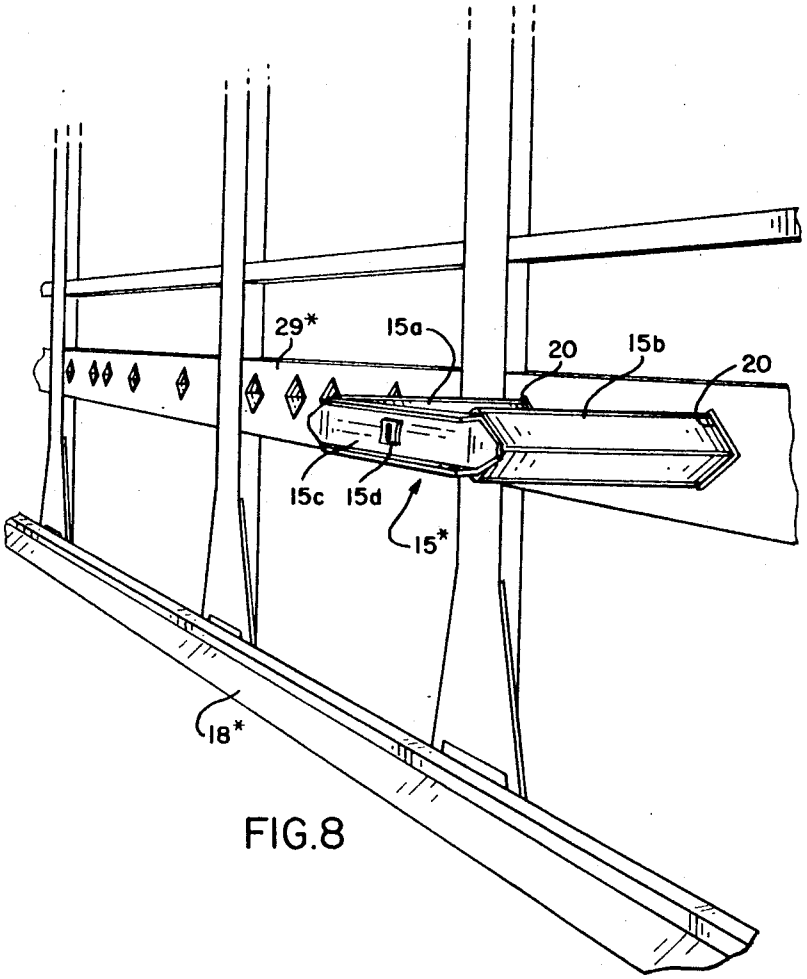
FIG. 8 is a perspective view of a front wheel seat inserted into a pair of horizontally oriented box receptacles in a horizontal side beam that runs the length of the railroad car.

When the improved railroad car is prepared for loading semistacked trucks, wheel seats 15* are removed from their stowed position and inserted into box receptacles 20 as shown in FIG. 8 at locations which are predetermined for the lengths of trucks to be loaded. Each wheel seat 15* is comprised of a pair of box beams **15*a* and 15*b* and a cross beam 15*c* which ties together the free cantilevered ends of the box beams 15*a* and 15*b***.

Figure 9A:
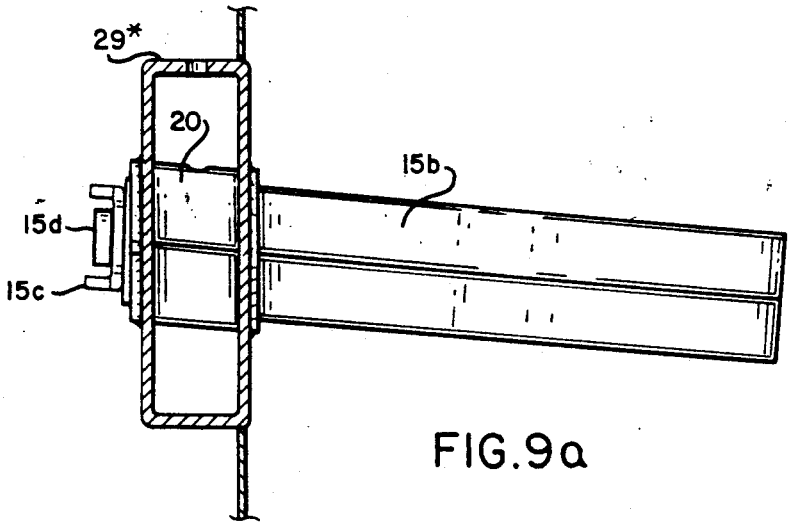
FIG. 9*a* is a cross sectional view of a front wheel seat inserted into the horizontal receptacles until a cross beam abuts the receptacles.
Figure 9B:
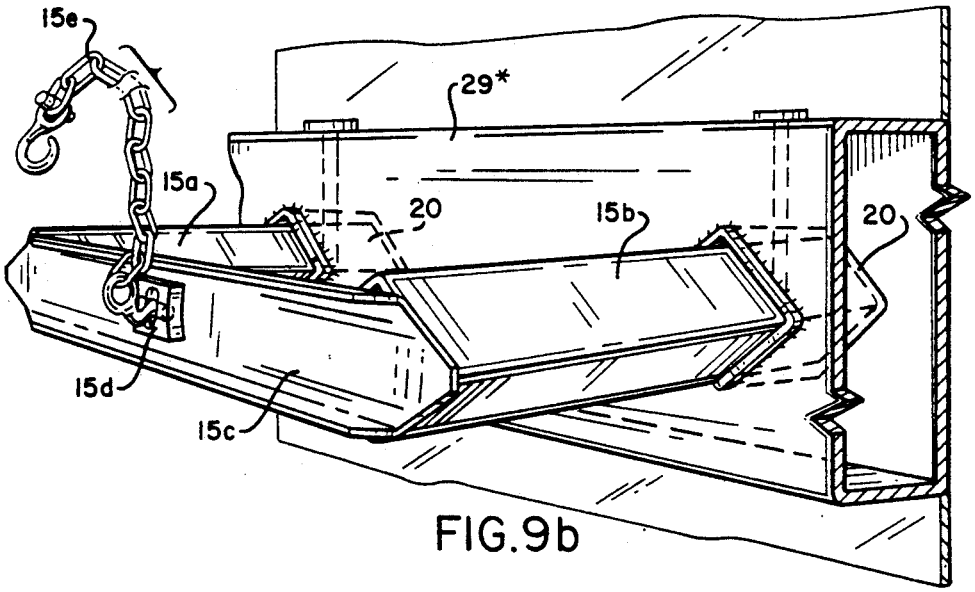
FIG. 9*b* is a perspective view of the box beams of the wheel seat protruding outside of the railroad car.
Figure 9C:
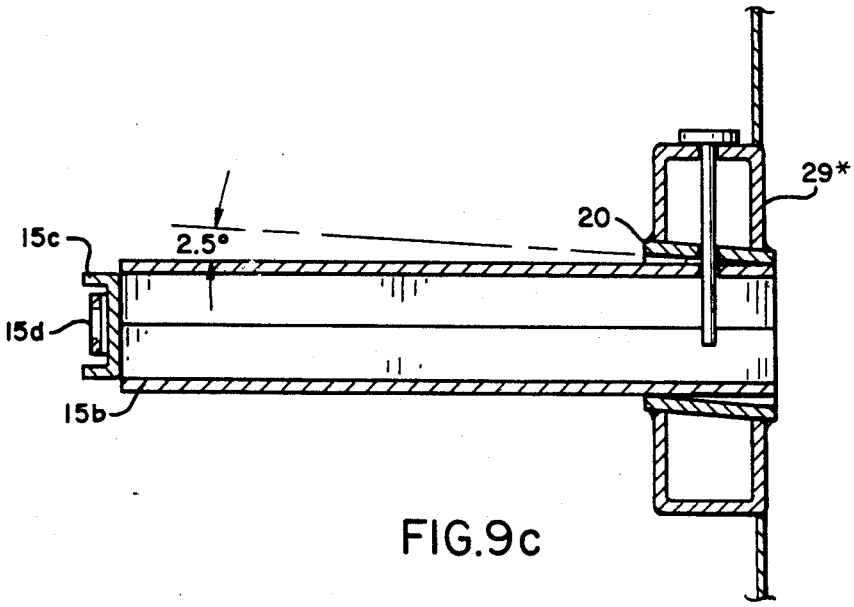
FIG. 9*c* is a cross sectional view of a front wheel seat inserted into the horizontal receptacle.

In order to be able to load trucks without being impeded by the wheel seats 15* the box beams **15*a* and 15*b* are pushed into a pair of receptacles 20 until the cross beam 15*c* abuts the receptacles 20**, as shown in FIG. 9*a*. At this time, the box beams **15*a* and 15*b* protrude outside the railroad car. As each truck is loaded in succession using a forklift to raise the front end and back the truck into position, the front wheel seats 15* on both sides of the railroad car are pulled back out away from the box receptacles 20** as shown in FIG. 9*b*. The cross beam **15*c* is thus passed under the front wheels of the truck, one on each side of the railroad car. A pin 20*a* is then dropped into aligned holes in the horizontal box beam 29*, box receptacles 20 and the box beams 15*a* and 15*b***, as shown in FIG. 9*c*. This locks the wheel seat 15* in place. Once that is done, the forklift is lowered and backed out of the railroad car to back another truck into the railroad car with its frame behind the cab (or cab position) tucked under the front end of the preceding truck as shown in FIG. 2.

The cross beam **15*c* has welded to it an eye 15*d* which receives a T-hook on the end of a chain 15*e*** shown in FIG. 9*b*. That chain is wrapped around the axle of the seated front wheel of the truck thus loaded. The other end of the chain is secured by a hook to a link of the chain in a customary chain tie-down manner.

The flat sides **15*a* and 15*b* of the cantilevered box beams 15*** of each wheel seat are oriented at 45° with respect to a horizontal plane as shown in FIG. 9*b* in order to present a flat face of each box beam to a tire on the truck wheel. In that manner, each of the two supporting box beams of each wheel seat have a supporting side tangent to the tire and two sides that are perpendicular to the supporting tangent side. This provides maximum resistance to bending of the box beam under the weight of the front end of the truck. That resistance is enhanced by the cross beam **15*d* that ties together the ends of the cantilevered box beams 15*a* and 15*b***.

In summary, an enclosed railroad car of extraordinary height is provided with guide rails 18 about one foot above a flat bed and about 4.5 inches in front of stanchions that support the roof and side panels that enclose the railroad car. The extraordinary height of the car is enhanced by having the flat bed 40 at the lowest possible level. An advantage is that a conventional forklift may be readily used to back a truck into position. That is an advantage because then the loading and unloading procedure may be carried out at any location in a railroad yard. All that would be required is for a portable ramp to be put in place. Each truck may be backed into the railroad car under its own power before the forklift raises its front end, or the forklift may raise the front end slightly to back the truck up the ramp and then raise the front end to the necessary height for semistacking. The guide rails about one foot above the bed of the railroad car assist in guiding the truck as it is backed into position. Once a truck is in a proper semistacked position, a wheel seat comprised of a pair of box beams and a cross beam is pulled out to a cantilevered position under each front wheel to support the front end of the truck. An eye welded to the cross beam of the wheel seat receives the hook of a tie-down chain that is wrapped around the axle of the truck wheel and secured.

What is claimed is:

1. A railroad car for hauling semistacked highway trucks having a front end, a rearwardly extending frame, front wheels, rear wheels and axles, said railroad car having a flat bed at the lowest possible level and a roof supported by stanchions at an extraordinary height, each truck being backed into position by a forklift with the front end of the truck raised and its rearwardly extending frame tucked in under the front end of a preceding truck, comprising cantilevered wheel seats for support of the front wheels of semistacked trucks, each wheel seat being comprised of two cantilevered box beams inserted into box receptacles supported by horizontal box beams secured to said stanchions at a proper height above said flat bed for support of the front end of each truck, a cross beam secured to the free end of the cantilevered box beams to enhance the ability of said cantilevered wheel seat box beams to support the weight of the truck, said box receptacles being open at both ends to allow said cantilevered wheel seat box beams to be inserted all the way through until said cross beam abuts said box receptacles in order to have said wheel seats positioned out of the way of trucks being loaded until a truck is in proper position for its raised front end to be supported by a pair of wheel seats, at which time said cantilevered wheel seat box beams are retracted from said receptacles until said cantilevered and cross wheel seat box beams pass under a raised front wheel of a truck being loaded, and means for securing the end of a tie-down chain to said cross beam in a position directly below the axle of the supported wheel of the truck.

2. A railroad car as defined in claim 1 including guide rails secured to said stanchions about one foot from said bed and at least about six inches in front of said stanchions to assist in guiding said trucks into proper position.

3. A railroad car of extraordinary height from a bed thereof to a roof supported by stanchions along its sides for hauling semistacked highway trucks having a front end, a rearwardly extending frame, front wheels, rear wheels and axles, said trucks each having a front end and a frame without a body extending to the rear thereof, each truck to be loaded being lifted at its front end as it is backed into position where said front wheels are secured on seats protruding from side horizontal box beams supported by said stanchions, with each succeeding truck having said frame extending to the rear tucked under the front end of the preceding truck, comprising a plurality of wheel seats, each comprised of two cantilevered box beams spaced apart for support of a truck wheel and a cross beam for tying together the cantilevered ends of said box beams, pairs of transverse box receptacles spaced along said side horizontal box beams for receiving said cantilevered box beams of said wheel seats, one pair of box receptacles for each wheel seat, said box receptacles being open at both ends to permit said cantilevered box beams of said wheel seats to pass through from the inside of said railroad car to the outside to the extent that said cross beam abuts said box receptacles while trucks are being loaded, and to be cantilevered inside said railroad car in pairs, one wheel seat pair on each side of said railroad car to support a wheel of a raised front end of a truck in a semistacked position with its rearwardly extending frame under the front end of a preceding truck, at least one removable pin passing through aligned holes in said side horizontal box beam, a box receptacle and cantilevered box beam of a wheel seat to secure said wheel seat in a cantilevered position under a front wheel of a semistacked truck, and means for tying down each front wheel of a semistacked truck to a supporting wheel seat.

4. A railroad car for hauling semistacked trucks as defined in claim 3 wherein said means for tying down each front wheel of a semistacked truck to a supporting wheel seat is comprised of an eye secured to said cross beam for securing the end of a chain to be wrapped around the axle of the wheel to be tied down.

5. A system for more efficient utilization of the space of a railroad car for hauling highway trucks, said railroad car being completely enclosed by a roof supported by stanchions, walls on the sides secured to said stanchions, and doors on the ends, and having an extraordinary height from a flat bed to said roof for hauling said highway trucks, each with or without a cab on the front end of a frame, and no body on said frame extending to the rear of each truck, horizontal box beams on each side of said railroad car secured to said stanchions, a plurality of front wheel seats for supporting two raised front wheels of each truck at the level of said horizontal box beams, said front wheel seats being sufficiently light to enable a single person to place each seat in proper position as each truck is loaded with its front end raised, wherein the bed of said railroad car is provided as a planar surface throughout at the lowest possible level in order to maximize height inside said railroad car and enable a conventional forklift to be used to raise the front end of each truck and back it into position in said railroad car as said highway trucks are semistacked with their rearwardly extending frame of each truck under the front wheels of a preceding truck, said railroad car having guide rails having a face near said planar bed and in front of said stanchions to assist in guiding the rear wheels of said trucks as they are backed into position, each of said wheel seats being comprised of two parallel cantilevered box beams spaced apart a distance less than the diameter of inflated tires on said front wheels of a truck and oriented with each side thereof at 45° with respect to a horizontal plane, the center-to-center spacing between box beams of a wheel seat being equal to about $2 \times R \sin 45°$, where R is equal to about the average radius of front wheel tires of highway trucks to be hauled so that sides of said wheel seat box beams facing the center of the wheel tire flat against the tire on both sides of a vertical plane passing through the center of the wheel, said box beams of said wheel seat being supported by square box receptacles spaced along said horizontal box beams affixed to the sides of said railroad car, one horizontal box beam on each side throughout the length of the car, and each wheel seat comprises said two cantilevered box beams inserted into two said box receptacles in said horizontal box beam, and further comprises a cross beam which ties together the free ends of said two cantilevered box beams, said box receptacles in said horizontal box beams being open to the outside of said railroad car so that said cantilevered box beams of said wheel seats may be inserted all the way into said box receptacles with said cross beam between said free ends of said cantilevered wheel seat box beams abutting said box receptacles, thereby to allow said front wheel seats to be placed out of the way of trucks being loaded into said railroad car until each truck in succession is in proper position with front wheels raised at predetermined locations, whereupon said cantilevered and cross box beams of each wheel seat that is to support the front end of the truck is pulled back into said railroad car until the cross beams of the wheel seats pass under the front wheel of the truck, and a pin placed through at least one set of aligned holes in said horizontal box beam, box receptacle and cantilevered box beams to secure said wheel seat in place.

6. A system as defined in claim 5 wherein said front wheel seats may be stored in vertically oriented box receptacles secured behind the face of said guide rails, whereby a single person may readily remove a wheel seat from its stowed position and place it into box receptacles in said horizontal box beam with its cantilevered box beams protruding outside the railroad car until a truck is loaded and then pulled back in and secured in its proper position.

7. A system as defined in claim 5 wherein said front wheels of a loaded truck are tied down to their respective cantilevered wheel seats by a chain between an eye on said cross beam and of the wheel seat and the front wheel axle of said truck.

* * * * *